US008714060B2

(12) United States Patent
Davis

(10) Patent No.: US 8,714,060 B2
(45) Date of Patent: May 6, 2014

(54) SYSTEM FOR ACCURATELY CUTTING SHEET MATERIAL

(76) Inventor: Doris T Davis, Grayson, GA (US)

( * ) Notice: Subject to any disclaimer, the term of this patent is extended or adjusted under 35 U.S.C. 154(b) by 247 days.

(21) Appl. No.: 13/170,445

(22) Filed: Jun. 28, 2011

(65) Prior Publication Data

US 2012/0279367 A1 Nov. 8, 2012

Related U.S. Application Data

(60) Provisional application No. 61/482,027, filed on May 3, 2011.

(51) Int. Cl.
*B26D 5/08* (2006.01)

(52) U.S. Cl.
USPC ..... 83/13; 83/562; 83/565

(58) Field of Classification Search
USPC ..... 83/565, 821, 442, 438; 33/562, 566, 33/563
See application file for complete search history.

(56) References Cited

U.S. PATENT DOCUMENTS

| | | | | |
|---|---|---|---|---|
| 4,177,570 | A * | 12/1979 | Hewitt | 33/548 |
| 5,484,373 | A * | 1/1996 | Carbone | 493/59 |
| 5,791,062 | A * | 8/1998 | Walker | 33/563 |
| 5,829,150 | A * | 11/1998 | McEligot | 33/562 |
| 6,286,224 | B1 * | 9/2001 | Lewis | 33/562 |
| 7,185,441 | B2 * | 3/2007 | Lockyer | 33/562 |
| 7,383,640 | B2 * | 6/2008 | Barry | 33/562 |
| 7,568,295 | B1 * | 8/2009 | Strain | 33/566 |
| 7,992,316 | B1 * | 8/2011 | Dickson | 33/562 |
| 2012/0085208 | A1 * | 4/2012 | Supernavage et al. | 83/13 |

* cited by examiner

*Primary Examiner* — Omar Flores Sanchez
(74) *Attorney, Agent, or Firm* — Craig Miles; CR Miles, P.C.

(57) ABSTRACT

Successive strips of material may be cut to uniform widths by placing at least a first spacing guide on an edge of the material so that the first spacing guide overlies the material and placing at least a second spacing guide in contact with the first spacing guide so that the second spacing guide overlies the material and so that combined widths of the spacing guides correspond to desired width of the strips. A hand support maybe placed adjacent the second spacing guide and in overlying relationship with the material. The first and second spacing guides may be removed from the material and the material may be cut along an edge of the hand support.

10 Claims, 3 Drawing Sheets

SYSTEM FOR ACCURATELY CUTTING SHEET MATERIAL

RELATED APPLICATIONS

This application claims the benefit of U.S. Provisional Patent Application No. 61/482,027 filed May 6, 2011.

BACKGROUND OF THE INVENTION

The present invention generally relates to cutting sheet material, and more particularly, to cutting multiple strips of the material so that each of the strips has the same width.

In various craft or quilting projects, a need may arise to cut numerous strips of material with a defined width. In many instances, these cut strips may be joined together to form a pattern. If the cut strips vary in size from one another, variations in width may accumulate as multiple strips are joined together. This may result in undesirable distortions of the desired pattern.

In order to minimize such distortions, a person must painstakingly measure a distance from a free edge of material to a cutting line for each strip. This measuring activity may involve using a ruler with scale markings that may show distance in fractions of inches or centimeters. Each successive measurement may be subject to error because of possible misreading of scale markings or inconsistent placement of a cutting line relative to a selected mark of the ruler. For example, a cutting line may be placed on a center of a mark in one instance and on an outside edge of a mark in a next instance.

As can be seen, there is a need for a system that will allow a person to cut accurately-sized multiple strips without a need for interpreting a graduated scale of a ruler or other measuring device.

SUMMARY OF THE INVENTION

In one aspect of the present invention, a collection of spacing guides for cutting strips of sheet material may comprise: at least one fractional-unit spacing guide and at least one integer-unit spacing guide.

In another aspect of the present invention, a method for cutting strips of material may comprise the steps of: providing for placing at least a first spacing guide on an edge of the material so that the first spacing guide overlies the material; providing for placing at least a second spacing guide in contact with the first spacing guide so that the second spacing guide overlies the material and so that combined widths of the spacing guides correspond to desired width of the strips; providing for placing a hand support adjacent the second spacing guide and in overlying relationship with the material; providing for removing the first and second spacing guides from the material; and providing for cutting the material along an edge of the hand support.

These and other features, aspects and advantages of the present invention will become better understood with reference to the following drawings, description and claims.

DETAILED DESCRIPTION OF THE INVENTION

The following detailed description is of the best currently contemplated modes of carrying out exemplary embodiments of the invention. The description is not to be taken in a limiting sense, but is made merely for the purpose of illustrating the general principles of the invention, since the scope of the invention is best defined by the appended claims.

Various inventive features are described below that can each be used independently of one another or in combination with other features.

Broadly, embodiments of the present invention generally provide collections of spacing guides having various widths such that the guides may be employed in various combinations to define a distance from an edge of material so that a cutting device may cut sets of strips with each strip having the same width.

Referring to the Figures, it may be seen that an exemplary embodiment of a collection 10 of spacing guides 12 may comprise numerous ones of the spacing guides 12. The spacing guides 12 may be comprised of flat material such as acrylic plastic and may be about ⅛ inch thick and about 24 inches long. Each of the spacing guides 12 may have a width different from any other one of the spacing guides 12 of the collection 10.

Figure 2:
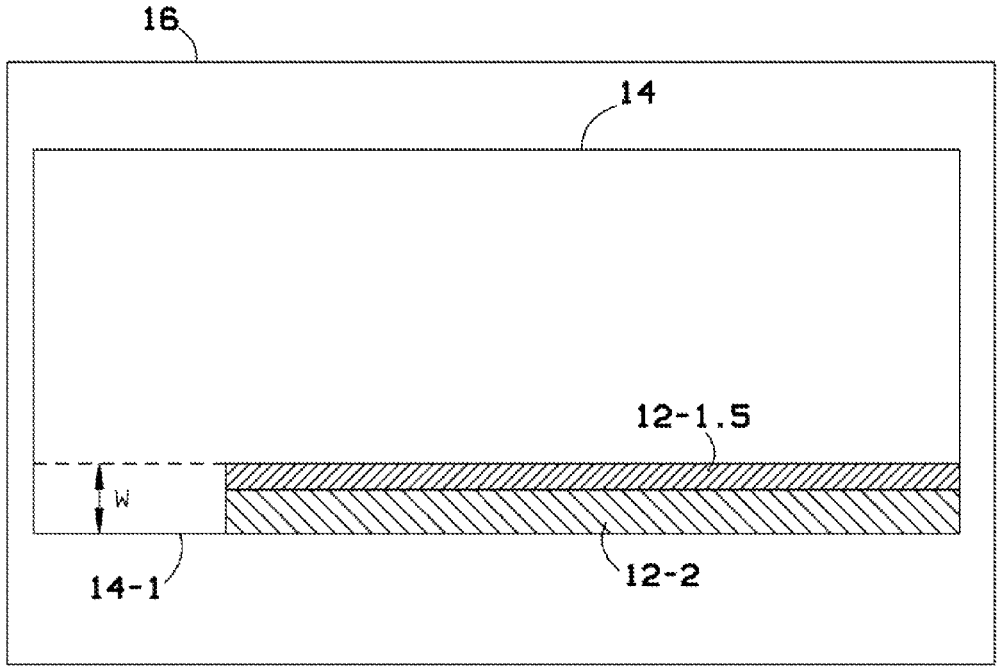
FIGS. 2, 3 and 4 are illustrations of an operational sequence for cutting a strip of material in accordance with an embodiment of the invention.
Figure 3:
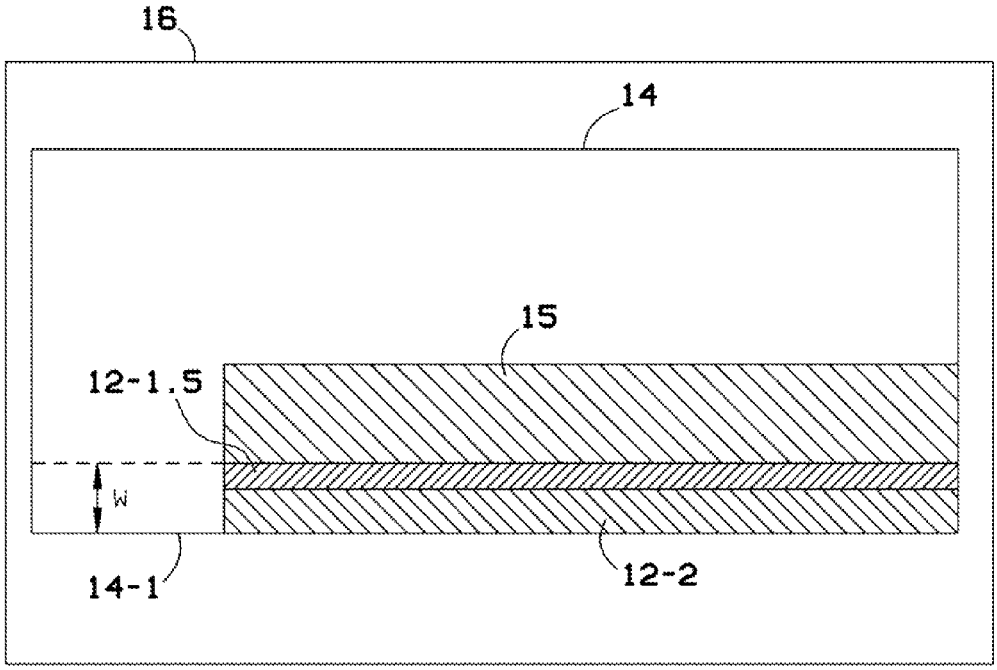
Figure 4:
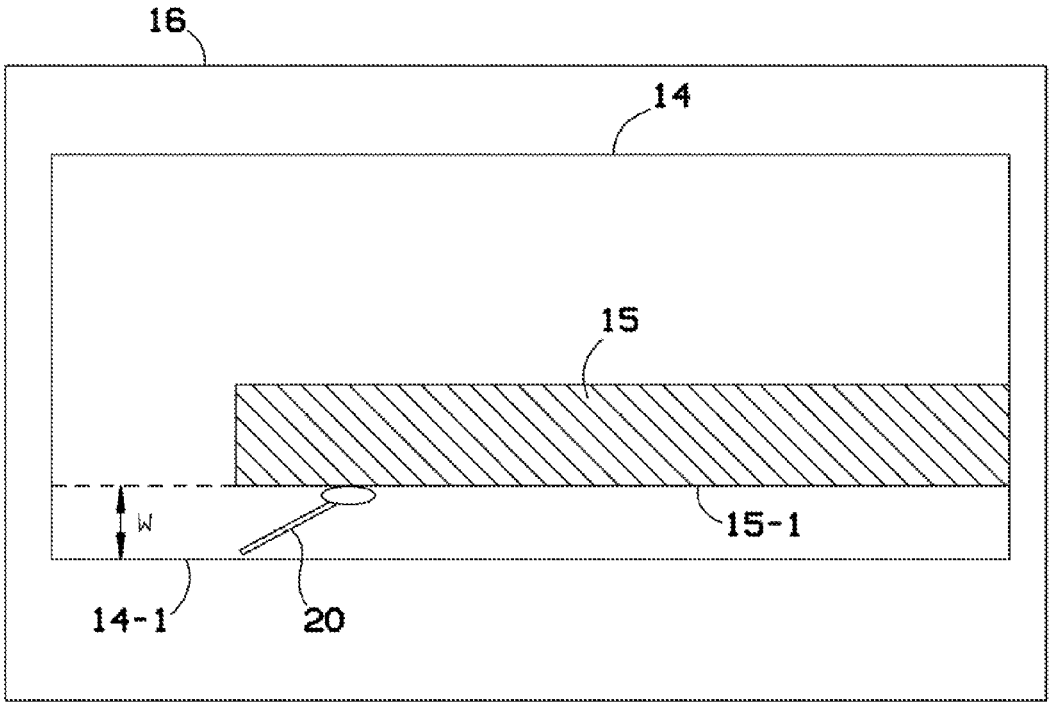

In operation, the cutting guides 12 may be employed during cutting of strips of sheet material as illustrated in FIGS. 2 through 4. As shown in FIG. 2, a piece of sheet material 14 (e.g., fabric or foam board or other craft material) may be positioned on a cutting surface 16. A desired exemplary width W for a strip may be selected as 3½ inches. One of the guides 12, a guide 12-2, having a width of 2 inches may be placed on the material 14 and aligned with an edge 14-1. Another one of the guides 12, a guide 12-1.5, having a width of 1½ inch may be placed next to and in contact with the guide 12-1.

As shown in FIG. 3 a hand support 15 may be placed adjacent to and in contact with the guide 12-1.5. A user may hold the support 15 in position on the material 14 and then remove the guides 12-2 and 12-1.5 from the material as shown in FIG. 4. It may be seen that after the guides 12-2 and 12-1.5 are removed, an edge 15-1 of the support 15 may be in position for use as a bearing surface for a rotary cutter 20. A user may hold the support 15 firmly in place and roll the cutter 20 along the edge 15-1 so that the material 14 is cut at the distance W (e.g., the exemplary 3½ inches) from the edge 14-1 of the material.

Successive 3½ strips of the material 14 may be cut by repeating the above described steps. Each of the successive strips may be equally sized because the user may not be subject to making errors associated with placing a conventional graduated ruler on the material and determining on which side of a graduated line the edge 14-1 should be aligned.

The collections 10 may be comprised of an appropriate number of the guides 12 to suit a particular user's needs. For example, if a user were using an inch-based measuring system and needed strips varying from 2½ inches to 6½ inches with size increments no smaller than ½ inch, then the collection 10 may comprise a base collection of a fractional-unit guide with a 1½ width, and integer-unit guides having a 1 inch width, a 2 inch width and a 3 inch width. If size increments of ¼ inch were desired, the collection 10 could be comprised of the base collection and additional fractional-unit guides with widths of 1¼ inch and 1¾ inch. Similarly if size increments of 1/8 were desired than still further additional fractional-unit guides having widths of 1 1/8, 1 3/8, 1 5/8 and 1 7/8 could be added to the collection 10. Even further, if size increments of 1/16 were desired, then additional guides having widths of 1 1/16, 1 3/16, 1 5/16 and 1 7/16, 1 9/16, 1 11/16, 1 13/16 and 1 15/16 could be added to the collection 10.

If a user were using one of the collections 10 to cut strips based on a centimeter measuring system, then similar combinations of the guides 12 could be assembled to provide desired compositions for the collections 10.

Figure 5:
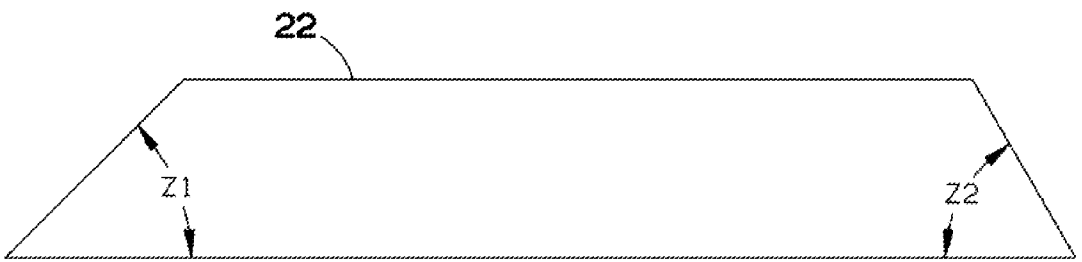
FIG. 5 is an elevation view of an angle cutting guide that may be optionally employed with the collection of FIG. 1.
Figure 1:
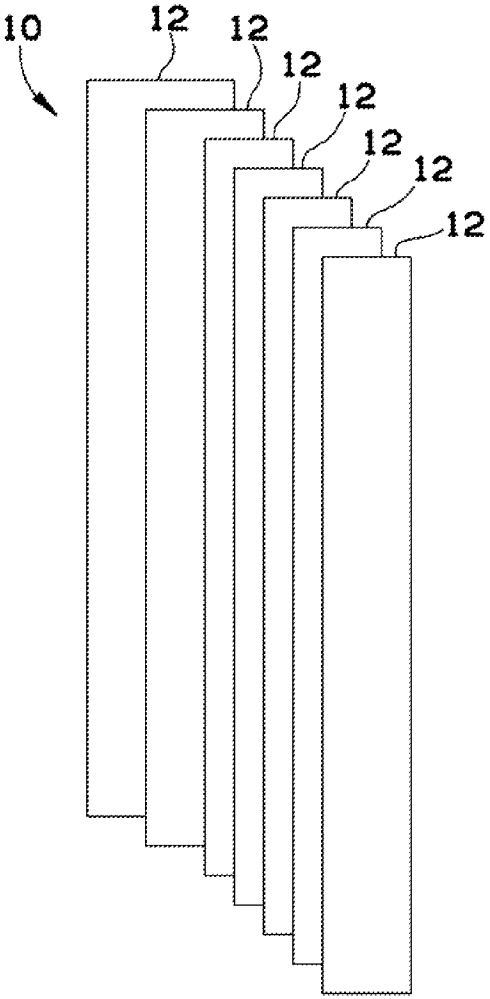
FIG. 1 is a perspective view of a collection of spacing guides in accordance with an embodiment of the invention.

Optionally, when one of the collections 10 may be sold to a user, the user may also be provided with one of the hand supports 15 which may comprise a flat sheet of acrylic having a width of about 6 inches or wider and having thickness of about 1/8 inch and length of about 24 inches. A width of six inches or more may be desirable to allow a user's hand to comfortably hold the support 15 without risk of cutting his or her hand with the rotary cutter 20. Still further, a user may be provided with an angle cutting guide 22, as shown in FIG. 5 with an overall length of about 12 inches, an angle Z1 being 45° and an angle Z2 being 60°.

It should be understood, of course, that the foregoing relates to exemplary embodiments of the invention and that modifications may be made without departing from the spirit and scope of the invention as set forth in the following claims.

What is claimed is:

1. A method for cutting strips of a material, comprising:

placing at least a first spacing guide overlaying and aligned with an edge of said material;

placing at least a second spacing guide in contact with said first spacing guide and overlaying said material, wherein combined widths of said first and second spacing guides correspond to a width of said strips;

placing a hand support adjacent said second spacing guide and overlying said material;

removing said first and second spacing guides from said material; and cutting material along an edge of said hand support.

2. The method of claim 1, further comprising successively repeating the steps of claim 1 to successively produce said strips of material having said width.

3. The method of claim 1, wherein one of said spacing guides comprises a fractional-unit spacing guide.

4. A kit including spacing guides for cutting strips of sheet material, comprising:

at least one integer-unit spacing guide, wherein said at least one integer-unit spacing guide has a width corresponding to an integer in a measuring system;

at least one fractional-unit spacing guide, wherein said at least one fractional-unit spacing guide has a width corresponding to an integer fraction in said measuring system, wherein said at least one integer-unit spacing guide and said at least one fractional-unit spacing guide each having a configuration which allows a first one of said at least one integer-unit spacing guide or said at least one fractional-unit spacing guide to be placed overlaying and aligned with an edge of a material;

a hand support configured to be placed adjacent said at least one integer-unit spacing guide or said at least one fractional-unit spacing guide overlaying said material, said hand support placed adjacent said at least one integer-unit spacing guide or said at least one fractional-unit spacing guide overlaying said material has a combined width corresponding to a width for cutting said strips of said material and which allows said at least one integer-unit spacing guide or said fractional-unit spacing guide to be removed from said material and said material cut along an edge of said hand support.

5. The kit of claim 4 wherein the at least one fractional-unit spacing guide is wider than one inch.

6. The kit of claim 4 wherein the spacing guides are acrylic.

7. The kit of claim 4 further comprising a plurality of the integer-unit spacing guides.

8. The kit of claim 4 comprising: three of the integer-unit guides having a 1 inch width, a 2 inch width and a 3 inch width respectively; and the at least one fractional-unit guide has a width of 1 1/2 inches.

9. The kit of claim 8 further comprising: a fractional-unit guide having a width of 1 1/4 inches; and a fractional-unit guide having a width of 1 3/4 inches.

10. The kit of claim 9 further comprising: a fractional-unit guide having a width of 1 1/8 inches; a fractional-unit guide having a width of 1 3/8 inches; a fractional-unit guide having a width of 1 5/8 inches; and a fractional-unit guide having a width of 1 7/8 inches.

* * * * *